US011236459B2

(12) United States Patent
Cattorini

(10) Patent No.: US 11,236,459 B2
(45) Date of Patent: Feb. 1, 2022

(54) LAUNDRY TREATING APPLIANCE HAVING A TREATING CHEMISTRY DISPENSER

(71) Applicant: WHIRLPOOL CORPORATION, Benton Harbor, MI (US)

(72) Inventor: Marco Cattorini, Gallarate (IT)

(73) Assignee: Whirlpool Corporation, Benton Harbor, MI (US)

( * ) Notice: Subject to any disclaimer, the term of this patent is extended or adjusted under 35 U.S.C. 154(b) by 249 days.

(21) Appl. No.: 16/509,659

(22) Filed: Jul. 12, 2019

(65) Prior Publication Data

US 2021/0010187 A1 Jan. 14, 2021

(51) Int. Cl.

*D06F 39/02* (2006.01)
*D06F 39/14* (2006.01)
*D06F 25/00* (2006.01)

(52) U.S. Cl.

CPC ..... *D06F 39/028* (2013.01); *D06F 25/00* (2013.01); *D06F 39/022* (2013.01); *D06F 39/14* (2013.01)

(58) Field of Classification Search

CPC ..... D06F 39/022; D06F 39/028; D06F 39/14; D06F 25/00

See application file for complete search history.

(56) References Cited

U.S. PATENT DOCUMENTS

| | | | | |
|---|---|---|---|---|
| 7,934,280 | B2 | 5/2011 | Kim et al. | |
| 8,074,476 | B2 * | 12/2011 | Quandt | D06F 39/02 68/17 R |
| 8,919,154 | B2 | 12/2014 | Kim et al. | |
| 8,997,290 | B2 | 4/2015 | Kim et al. | |
| 9,115,461 | B2 * | 8/2015 | Anderson | D06F 37/28 |
| 9,121,125 | B2 | 9/2015 | Kim et al. | |
| 9,469,931 | B2 * | 10/2016 | Anderson | D06F 37/06 |
| 9,587,345 | B2 | 3/2017 | Cho | |
| 9,663,893 | B2 * | 5/2017 | Malheiros | D06F 33/00 |
| 10,253,443 | B2 * | 4/2019 | Harbrecht | D06F 39/14 |
| 2007/0240456 | A1 * | 10/2007 | Byun | D06F 39/02 68/17 R |
| 2011/0099727 | A1 | 5/2011 | Kim et al. | |
| 2012/0266389 | A1 * | 10/2012 | Ihne | D06F 39/028 8/137 |
| 2017/0306550 | A1 | 10/2017 | Harbrecht et al. | |
| 2017/0306551 | A1 | 10/2017 | Kim et al. | |

FOREIGN PATENT DOCUMENTS

| | | | |
|---|---|---|---|
| CN | 106702685 | A | 5/2017 |
| CN | 107090697 | A | 8/2017 |
| CN | 108179589 | A | 6/2018 |
| EP | 0628651 | B1 | 11/1999 |
| EP | 2092104 | B1 | 4/2010 |
| EP | 2743393 | B1 | 7/2015 |
| KR | 20060102926 | A | 9/2006 |
| KR | 100701934 | B1 | 3/2007 |

* cited by examiner

*Primary Examiner* — Benjamin L Osterhout
(74) *Attorney, Agent, or Firm* — McGarry Bair PC

(57) ABSTRACT

A laundry treating appliance for treating laundry items according to an automatic cycle of operation includes a cabinet defining an interior. The cabinet has a front panel that at least partially defines an access opening to the interior. A treating chamber is located within the cabinet and accessible by the access opening. A closure is movably mounted to the cabinet to selectively open and close the access opening. The closure has a rear face confronting the treating chamber when the closure closes the access opening. The laundry treating appliance further includes a treating chemistry dispenser.

20 Claims, 8 Drawing Sheets

LAUNDRY TREATING APPLIANCE HAVING A TREATING CHEMISTRY DISPENSER

BACKGROUND

Laundry treating appliances, such as clothes washers, refreshers, and non-aqueous systems, can have a configuration based on a rotating laundry basket or drum that defines a drum opening and at least partially defines a treating chamber in which laundry items are placed for treating. The laundry treating appliance can include a cabinet including a panel with an access opening through which laundry items are loaded and unloaded into the treating chamber. A closure can be movably mounted to the cabinet to selectively open and close the access opening to the treating chamber. A bellows can be provided to extend at least partially between the access opening and the drum opening.

The laundry treating household appliance can have a controller that implements a number of user-selectable, pre-programmed cycles of operation having one or more operating parameters. Hot water, cold water, or a mixture thereof, along with various treating chemistries, can be supplied to the treating chamber in accordance with the cycle of operation. The laundry treating household appliance can have a dispenser for loading of treating chemistries into the appliance by the user and for supplying various treating chemistries to the treating chamber.

BRIEF SUMMARY

An aspect of the present disclosure relates to a laundry treating appliance for treating laundry items according to an automatic cycle of operation, the laundry treating appliance comprising a cabinet defining an interior and having a front panel that at least partially defines an access opening to the interior, a treating chamber located within the cabinet and accessible by the access opening, a closure movably mounted to the cabinet to selectively open and close the access opening and having a rear face confronting the treating chamber when the closure closes the access opening, and a bulk treating chemistry dispenser mounted to the rear face and protruding through the access opening when the closure closes the access opening, the bulk treating chemistry dispenser comprising at least one bulk treating chemistry reservoir extending along the vertical height of the access opening, a dispenser inlet formed at an upper end of the bulk treating chemistry dispenser and fluidly coupled to a water supply, a dispenser outlet formed at a lower end of the bulk treating chemistry dispenser and fluidly coupled to the treating chamber, and a mixing conduit extending between the dispenser inlet and the dispenser outlet and fluidly coupled to the at least one bulk treating chemistry reservoir.

DETAILED DESCRIPTION

Figure 1:
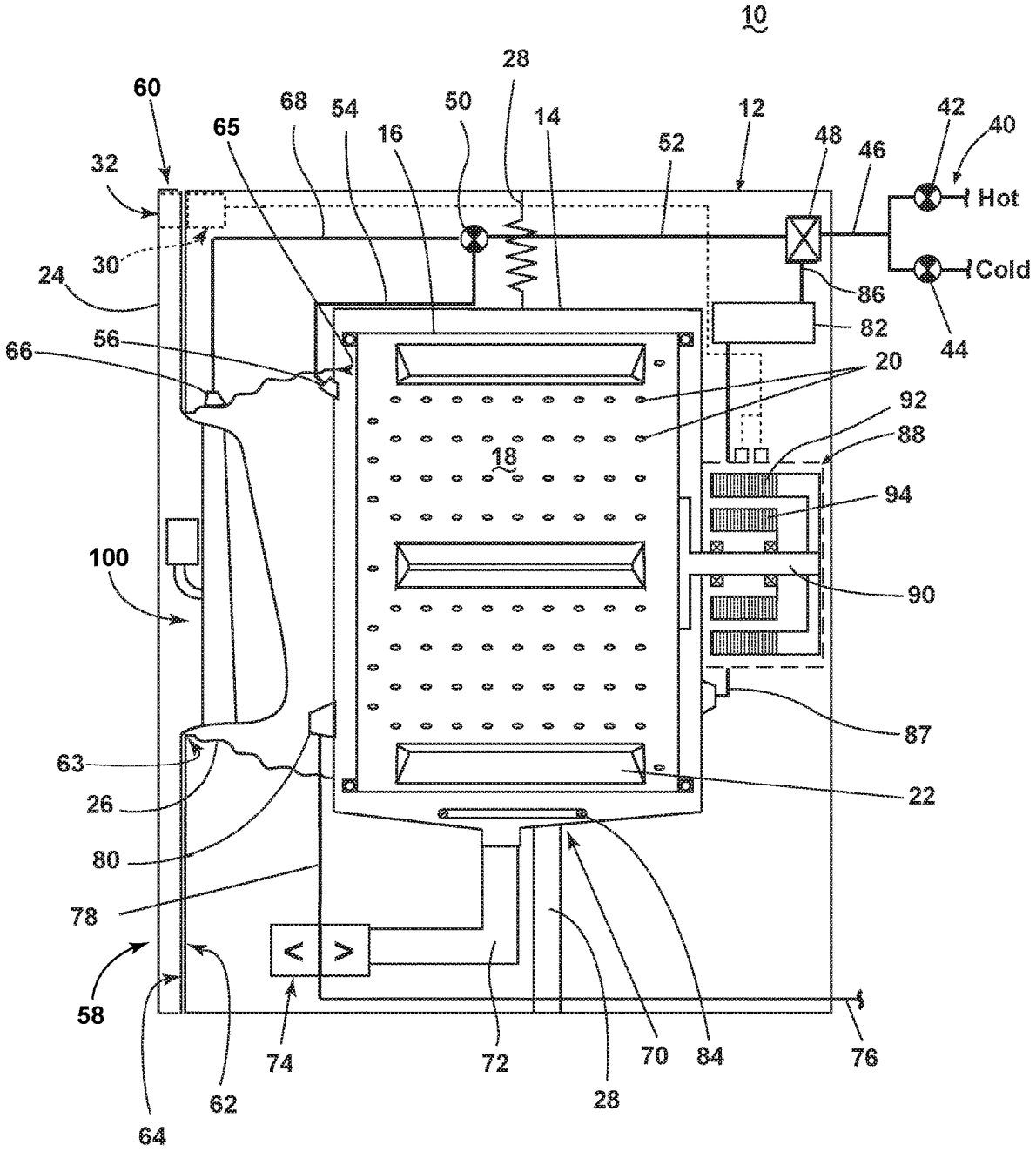
FIG. 1 is a schematic cross-sectional view of a laundry treating appliance including a closure in a closed condition.

FIG. 1 illustrates a schematic view of a laundry treating appliance 10 according to an aspect of the present disclosure. The laundry treating appliance 10 can be any laundry treating appliance 10 that performs a cycle of operation to clean or otherwise treat laundry items placed therein, non-limiting examples of which include a horizontal or vertical axis clothes washer; a combination washing machine and dryer; a tumbling or stationary refreshing/revitalizing machine; an extractor; a non-aqueous washing apparatus; and a revitalizing machine. While the laundry treating appliance 10 is illustrated herein as a horizontal axis, front-load laundry treating appliance 10, the aspects of the present disclosure can have applicability in laundry treating appliances with other configurations. The laundry treating appliance 10 shares many features of a conventional automated clothes washer and/or dryer, which will not be described in detail herein except as necessary for a complete understanding of the exemplary aspects in accordance with the present disclosure.

Laundry treating appliances are typically categorized as either a vertical axis laundry treating appliance or a horizontal axis laundry treating appliance. As used herein, the term "horizontal axis" laundry treating appliance refers to a laundry treating appliance having a rotatable drum that rotates about a generally horizontal axis relative to a surface that supports the laundry treating appliance. The drum can rotate about the axis inclined relative to the horizontal axis, with fifteen degrees of inclination being one example of the inclination. Similar to the horizontal axis laundry treating appliance, the term "vertical axis" laundry treating appliance refers to a laundry treating appliance having a rotatable drum that rotates about a generally vertical axis relative to a surface that supports the laundry treating appliance. However, the rotational axis need not be perfectly vertical to the surface. The drum can rotate about an axis inclined relative to the vertical axis, with fifteen degrees of inclination being one example of the inclination.

In another aspect, the terms vertical axis and horizontal axis are often used as shorthand terms for the manner in which the appliance imparts mechanical energy to the laundry, even when the relevant rotational axis is not absolutely vertical or horizontal. As used herein, the "vertical axis" laundry treating appliance refers to a laundry treating appliance having a rotatable drum, perforate or imperforate, that holds fabric items and, optionally, a clothes mover, such as an agitator, impeller, nutator, and the like within the drum. The clothes mover can move within the drum to impart mechanical energy directly to the clothes or indirectly through wash liquid in the drum. The clothes mover can typically be moved in a reciprocating rotational movement. In some vertical axis laundry treating appliances, the drum rotates about a vertical axis generally perpendicular to a surface that supports the laundry treating appliance. However, the rotational axis need not be vertical. The drum can rotate about an axis inclined relative to the vertical axis.

As used herein, the "horizontal axis" laundry treating appliance refers to a laundry treating appliance having a rotatable drum, perforated or imperforate, that holds laundry items and washes and/or dries the laundry items. In some horizontal axis laundry treating appliances, the drum rotates about a horizontal axis generally parallel to a surface that supports the laundry treating appliance. However, the rotational axis need not be horizontal. The drum can rotate about an axis inclined or declined relative to the horizontal axis. In horizontal axis laundry treating appliances, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines are best differentiated by the manner in which they impart mechanical energy to the fabric articles.

Regardless of the axis of rotation, a laundry treating appliance can be top-loading or front-loading. In a top-loading laundry treating appliance, laundry items are placed into the drum through an access opening in the top of a cabinet, while in a front-loading laundry treating appliance laundry items are placed into the drum through an access opening in the front of a cabinet. If a laundry treating appliance is a top-loading horizontal axis laundry treating appliance or a front-loading vertical axis laundry treating appliance, an additional access opening is located on the drum.

In more detail, the laundry treating appliance 10 can include a structural support assembly comprising a cabinet 12 defining a housing within which a laundry holding assembly resides. The cabinet 12 can be a housing having a chassis and/or a frame, to which decorative panels can or cannot be mounted, defining an interior, enclosing components typically found in a conventional laundry treating appliance, such as an automated clothes washer or dryer, which can include motors, pumps, fluid lines, controls, sensors, transducers, and the like. Such components will not be described further herein except as necessary for a complete understanding of the present disclosure. The cabinet 12 can include a front panel 62 that at least partially defines an access opening 63 to allow user access to the interior of the cabinet 12.

The laundry holding assembly of the illustrated exemplary laundry treating appliance 10 can include a tub 14 dynamically suspended within the structural support assembly of the cabinet 12 by a suitable suspension assembly 28, the tub 14 at least partially defining a treating chamber 18 for laundry items. A rotatable drum 16 can be provided within the tub 14 to further define at least a portion of the treating chamber 18. The treating chamber 18 is configured to receive a laundry load comprising laundry items for treatment, including, but not limited to, a hat, a scarf, a glove, a sweater, a blouse, a shirt, a pair of shorts, a dress, a sock, and a pair of pants, a shoe, an undergarment, and a jacket. The access opening 63 can provide access to the treating chamber 18.

The drum 16 can include a plurality of perforations 20 such that liquid can flow between the tub 14 and the drum 16 through the perforations 20. A plurality of baffles 22 can be disposed on an inner surface of the drum 16 to lift the laundry load received in the treating chamber 18 while the drum 16 rotates. It is also within the scope of the present disclosure for the laundry holding assembly to comprise only one receptacle, such as the tub 14, without the drum 16, with the receptacle defining the laundry treating chamber 18 for receiving the load to be treated.

The tub 14 can also define a tub opening 65, which can be at least partially aligned with the access opening 63 of the front panel 62 of the cabinet 12. In one example, the tub 14, along with the tub opening 65, the drum 16, and the access opening 63, can have central axes that are co-axial with one another, or with at least one of the other axes, such that a common central axis is formed. A bellows 26 can extend between the tub opening 65 and the access opening 63 to couple the access opening 63 of the front panel 62 with the tub opening 65. The bellows 26 can sealingly couple the tub opening 65 and the access opening 63 such that liquid is not permitted to move from the tub 14 into the interior of the cabinet 12.

A closure, illustrated herein as a door assembly 24, can be movably mounted to or coupled to the cabinet 12 to selectively open and close the access opening 63 to the treating chamber 18. In one example, the door assembly 24 can be rotatable relative to the cabinet 12. By way of non-limiting example, the door assembly 24 can be hingedly coupled to the cabinet 12 for movement between an opened condition (FIG. 3) and a closed condition as shown. In the closed condition, the door assembly 24 can seal against the bellows 26 or the access opening 63, or both, when the door assembly 24 closes the access opening 63. In the opened condition, the door assembly 24 can be spaced apart from the access opening 63 and the bellows 26 and can allow access to the front panel 62 and the access opening 63.

The door assembly 24 comprises a front surface 58, a top surface 60, and a rear face 64, with the rear face 64 at least partially confronting the treating chamber 18 when the door assembly 24 is in the closed condition to close the access opening 63. The door assembly 24 can further include a bulk treating chemistry dispenser 100 that can be integrated with, mounted to, or coupled to the door assembly 24. The bulk treating chemistry dispenser 100 can be mounted to the rear face 64 such that the bulk treating chemistry dispenser 100 protrudes rearwardly from the rear face 64 and through the access opening 63 so as to be received within and to abut the bellows 26 when the door assembly 24 is in the closed condition. The bulk treating chemistry dispenser 100 can be sized and shaped so as to be received by and to protrude through the access opening 63 and can extend along the vertical height and the width of the access opening 63.

The laundry treating appliance 10 can further include a liquid supply assembly for supplying liquid, such as water or a combination of water and one or more wash aids, such as detergent, to the laundry treating appliance 10 for use in treating laundry during a cycle of operation. The liquid supply assembly can include a source of water, such as a household water supply 40, which can include separate valves 42 and 44 for controlling the flow of hot and cold water, respectively. The valves 42, 44 can be opened individually or together to provide a mix of hot and cold water at a selected temperature. The valves 42, 44 are selectively openable to provide water, such as from the household water supply 40, to be supplied through an inlet conduit 46 directly to the tub 14 by controlling first and second diverter mechanisms 48 and 50, respectively. The diverter mechanisms 48, 50 can each be a diverter valve having two outlets such that each of the diverter mechanisms 48, 50 can selectively direct a flow of liquid to one or both of two flow paths. Water from the household water supply 40 can flow through the inlet conduit 46 to the first diverter mechanism 48 which can direct the flow of liquid to a supply conduit 52. The second diverter mechanism 50 on the supply conduit 52 can direct the flow of liquid to a tub outlet conduit 54 which can be provided with a spray nozzle 56 configured to spray the flow of liquid into the tub 14 in a desired pattern and under a desired amount of pressure. For example, the spray nozzle 56 can be configured to dispense a flow or stream of water into the tub 14 by gravity, i.e. a non-pressurized stream. In this manner, water from the household water supply 40 can be supplied directly to the tub 14. While the valves 42, 44 and the conduit 46 are illustrated exteriorly of the cabinet 12, it will be understood that these components can be internal to the cabinet 12.

The bulk treating chemistry dispenser 100 can be configured for dispensing treating chemistry to the treating chamber 18 for use in treating the laundry according to a cycle of operation. While illustrated and described herein as a bulk treating chemistry dispenser 100, it will be understood that the treating chemistry dispenser can be any of a single dose dispenser, a bulk dispenser, or an integrated single dose and bulk dispenser. The bulk treating chemistry dispenser 100 is fluidly coupled to the treating chamber 18. The bulk treating chemistry dispenser 100 can be configured to dispense a treating chemistry directly to the tub 14 or mixed with water from the liquid supply assembly. The bulk treating chemistry dispenser 100 can include means for supplying or mixing detergent to or with water from the water supply 40. Alternatively or additionally, water from the water supply 40 can also be supplied to the tub 14 through the bulk treating chemistry dispenser 100 without the addition of a detergent. The bulk treating chemistry dispenser 100 can be configured to dispense the treating chemistry into the tub 14 in a desired pattern and under a desired amount of pressure. For example, the bulk treating chemistry dispenser 100 can be configured to dispense a flow or stream of treating chemistry into the tub 14 by gravity, i.e. a non-pressurized stream.

Water can be supplied to the bulk treating chemistry dispenser 100 from the supply conduit 52 by directing the diverter mechanism 50 to direct the flow of water to a dispensing supply conduit 68. The dispensing supply conduit 68 can include a dispensing nozzle 66 configured to dispense the flow of water to the bulk treating chemistry dispenser 100 in a desired pattern and under a desired amount of pressure.

The bulk treating chemistry dispenser 100 can include multiple chambers or reservoirs for receiving doses of different treating chemistries. The bulk treating chemistry dispenser 100 can be moveable between a fill position, wherein the bulk treating chemistry dispenser 100 is exterior to the cabinet 12 and can be filled with treating chemistry when the door assembly 24 is in the opened condition, and a dispense position, wherein the bulk treating chemistry dispenser 100 is interior of the cabinet 12 when the door assembly 24 is in the closed condition.

Non-limiting examples of treating chemistries that can be dispensed by the dispensing system during a cycle of operation include one or more of the following: water, detergents, surfactants, enzymes, fragrances, stiffness/sizing agents, wrinkle releasers/reducers, softeners, antistatic or electrostatic agents, stain repellents, water repellents, energy reduction/extraction aids, antibacterial agents, medicinal agents, vitamins, moisturizers, shrinkage inhibitors, and color fidelity agents, and combinations thereof. The treating chemistries can be in the form of a liquid, powder, or any other suitable phase or state of matter.

The laundry treating appliance 10 can also include a recirculation and drain assembly for recirculating liquid within the laundry holding assembly and draining liquid from the laundry treating appliance 10. Liquid supplied to the tub 14 through tub outlet conduit 54 and/or the bulk treating chemistry dispenser 100 typically enters a space between the tub 14 and the drum 16 and can flow by gravity to a sump 70 formed in part by a lower portion of the tub 14. The sump 70 can also be formed by a sump conduit 72 that can fluidly couple the lower portion of the tub 14 to the pump 74. The pump 74 can have an inlet fluidly coupled with the sump 70 and an outlet configured to fluidly couple and to direct liquid to the drain conduit 76, which can drain the liquid from the laundry treating appliance 10, or to the recirculation conduit 78, which can terminate at the recirculation inlet 80. In this configuration, the pump 74 can be used to drain or recirculate wash water in the sump 70. The recirculation inlet 80 can direct the liquid from the recirculation conduit 78 into the drum 16 by fluidly coupling the recirculation conduit 78 with the drum 16. The recirculation inlet 80 can introduce the liquid into the drum 16 in any suitable manner, such as by spraying, dripping, or providing a steady flow of liquid. In this manner, liquid provided to the tub 14, with or without treating chemistry can be recirculated into the treating chamber 18 for treating the laundry within. The recirculation and drain assembly can include other types of recirculation systems.

The liquid supply and/or recirculation and drain assembly can be provided with a heating assembly which can include one or more devices for heating laundry and/or liquid supplied to the tub 14, such as a steam generator 82 and/or a sump heater 84. Liquid from the household water supply 40 can be provided to the steam generator 82 through the inlet conduit 46 by controlling the first diverter mechanism 48 to direct the flow of liquid to a steam supply conduit 86. Steam generated by the steam generator 82 can be supplied to the tub 14 through a steam outlet conduit 87. The steam generator 82 can be any suitable type of steam generator such as a flow through steam generator or a tank-type steam generator. Alternatively, the sump heater 84 can be used to generate steam in place of or in addition to the steam generator 82. In addition or alternatively to generating steam, the steam generator 82 and/or sump heater 84 can be used to heat the laundry and/or liquid within the tub 14 as part of a cycle of operation. The sump heater 84 can be provided within the sump 70 to heat liquid that collects in the sump 70. Alternatively, the heating assembly can include an in-line heater that heats the liquid as it flows through the liquid supply, dispensing, and/or recirculation assemblies.

It is noted that the illustrated suspension assembly, liquid supply assembly, recirculation and drain assembly, and dispensing assembly are shown for exemplary purposes only and are not limited to the assemblies shown in the drawings and described above. For example, the liquid supply, dispensing, and recirculation and pump assemblies can differ from the configuration shown in FIG. 1, such as by inclusion of other valves, conduits, treating chemistry dispensers, heaters, sensors (such as water level sensors and temperature sensors), and the like, to control the flow of liquid through the laundry treating appliance 10 and for the introduction of more than one type of treating chemistry. For example, the liquid supply assembly can include a single valve for controlling the flow of water from the household water source. In another example, the recirculation and pump assembly can include two separate pumps for recirculation and draining, instead of the single pump as previously described. In yet another example, the liquid supply assembly can be configured to supply liquid into the interior of the drum 16 or into the interior of the tub 14 not occupied by the drum 16, such that liquid can be supplied directly to the tub 14 without having to travel through the drum 16.

The laundry treating appliance 10 also includes a drive assembly for rotating the drum 16 within the tub 14. The drive assembly can include a motor 88, which can be directly coupled with the drum 16 through a drive shaft 90 to rotate the drum 16 about a rotational axis during a cycle of operation. The motor 88 can be a brushless permanent magnet (BPM) motor having a stator 92 and a rotor 94. Alternately, the motor 88 can be coupled to the drum 16 through a belt and a drive shaft to rotate the drum 16, as is known in the art. Other motors, such as an induction motor or a permanent split capacitor (PSC) motor, can also be used. The motor 88 can rotationally drive the drum 16, including that the motor 88 can rotate the drum 16 at various speeds in either rotational direction.

The laundry treating appliance 10 also includes a control assembly for controlling the operation of the laundry treating appliance 10 and its various working components to control the operation of the working components and to implement one or more treating cycles of operation. The control assembly can include the controller 30 located within the cabinet 12 and the user interface 32 that is operably coupled with the controller 30. The user interface 32 can provide an input and output function for the controller 30. In one example, the user interface 32 can be provided or integrated with the door assembly 24, such as being located on the front surface 58 or the top surface 60. In another example, the user interface 32 can be provided on the front panel 62 of the cabinet 12, such that the user interface 32 may not be accessible by a user when the door assembly 24 is in the closed condition.

The user interface 32 can include one or more knobs, dials, switches, displays, touch screens and the like for communicating with the user, such as to receive input and provide output. For example, the displays can include any suitable communication technology including that of a liquid crystal display (LCD), a light-emitting diode (LED) array, or any suitable display that can convey a message to the user. The user can enter different types of information including, without limitation, cycle selection and cycle parameters, such as cycle options. Other communications paths and methods can also be included in the laundry treating appliance 10 and can allow the controller 30 to communicate with the user in a variety of ways. For example, the controller 30 can be configured to send a text message to the user, send an electronic mail to the user, or provide audio information to the user either through the laundry treating appliance 10 or utilizing another device such as a mobile phone.

The controller 30 can include the machine controller and any additional controllers provided for controlling any of the components of the laundry treating appliance 10. For example, the controller 30 can include the machine controller and a motor controller. Many known types of controllers can be used for the controller 30. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), can be used to control the various components.

Figure 2:
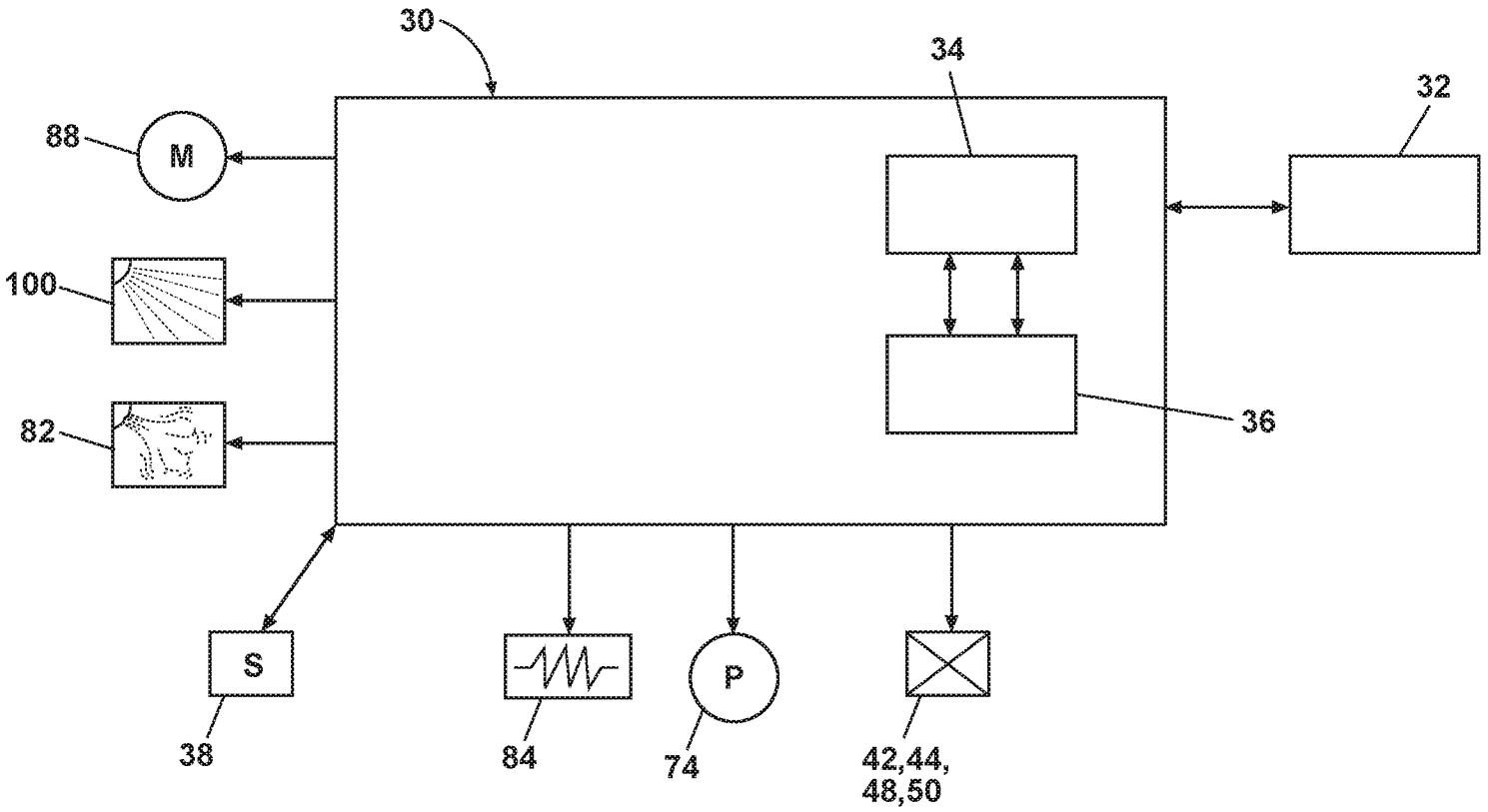
FIG. 2 is a schematic of a control assembly of the laundry treating appliance of FIG. 1.

As illustrated in FIG. 2, the controller 30 can be provided with a memory 34 and a central processing unit (CPU) 36. The memory 34 can be used for storing the control software that is executed by the CPU 36 in completing a cycle of operation using the laundry treating appliance 10 and any additional software. For example, the memory 34 can store a set of executable instructions including at least one user-selectable cycle of operation. Examples, without limitation, of cycles of operation include: wash, heavy duty wash, delicate wash, quick wash, pre-wash, refresh, rinse only, and timed wash, which can be selected at the user interface 32. The memory 34 can also be used to store information, such as a database or table, and to store data received from one or more components of the laundry treating appliance 10 that can be communicably coupled with the controller 30. The database or table can be used to store the various operating parameters for the one or more cycles of operation, including factory default values for the operating parameters and any adjustments to them by the control assembly or by user input.

The controller 30 can be operably coupled with one or more components of the laundry treating appliance 10 for communicating with and controlling the operation of the component to complete a cycle of operation. For example, the controller 30 can be operably coupled with the valves 42, 44 and the diverter mechanisms 48, 50 for controlling the temperature and flow rate of treating liquid into the treating chamber 18, the motor 88 for controlling the direction and speed of rotation of the drum 16, the pump 74 for controlling the amount of treating liquid in the treating chamber 18 or sump 70, the bulk treating chemistry dispenser 100 for controlling the flow of treating chemistries into the treating chamber 18, the user interface 32 for receiving user selected inputs and communicating information to the user, the steam generator 82, and the sump heater 84 to control the operation of these and other components to implement one or more of the cycles of operation.

The controller 30 can also be coupled with one or more sensors 38 provided in one or more of the assemblies of the laundry treating appliance 10 to receive input from the sensors 38, which are known in the art and not shown for simplicity. Non-limiting examples of sensors 38 that can be communicably coupled with the controller 30 include: a treating chamber temperature sensor, such as a thermistor, which can detect the temperature of the treating liquid in the treating chamber 18 and/or the temperature of the treating liquid being supplied to the treating chamber 18, a moisture sensor, a weight sensor, a chemical sensor, a position sensor, an imbalance sensor, a load size sensor, and a motor torque sensor, which can be used to determine a variety of assembly and laundry characteristics, such as laundry load inertia or mass.

Figure 3:
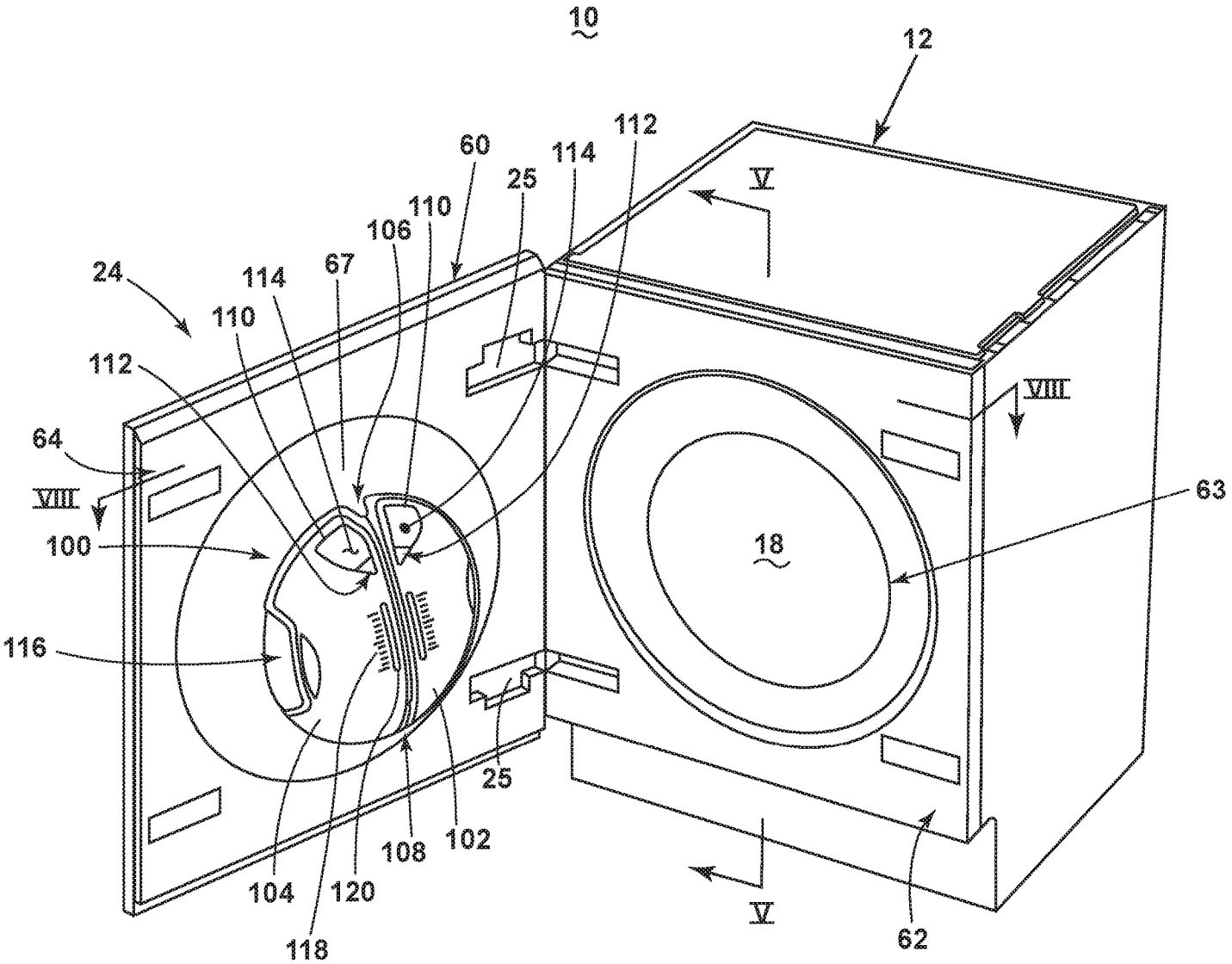
FIG. 3 is a top perspective view of the laundry treating appliance of FIG. 1 with the door assembly in an opened condition and including a bulk treating chemistry dispenser.

FIG. 3 illustrates a perspective view of the laundry treating appliance 10 with the door assembly 24 in the opened condition, spaced from the access opening 63 and exposing the front panel 62 of the cabinet 12 to view by a user. At least one hinge 25 can couple the door assembly 24 to the cabinet 12 for movement between the closed condition and the opened condition. While the door assembly 24 is illustrated herein as pivoting horizontally, it will be understood that the door assembly 24 can also be configured to pivot vertically. Any suitable closure mechanism can be used for securing the door assembly 24 in the closed condition. By way of non-limiting example, a catch or hook (not shown) can be provided on the front panel 62 for selective interaction with a latch (not shown) provided on the door assembly 24 and configured to resiliently retain the door assembly 24 in the closed condition until sufficient force is applied to overcome the coupling of the door assembly 24 with the front panel 62.

Other components, though not shown, can be included on or within the door assembly 24, such as on the top surface 60, non-limiting examples of which include the user interface 32, a display, or mode selectors. In the case that such components or any other components are provided with the door assembly 24 requiring electrical power, the wires for powering such components can pass from the cabinet 12 into the door assembly 24 by passing through the at least one hinge 25.

The rear face 64 of the door assembly 24 can comprise a bulkhead 67 to which the bulk treating chemistry dispenser 100 can be mounted or coupled. The bulk treating chemistry dispenser 100 comprises at least one bulk treating chemistry reservoir, illustrated herein as a first treating chemistry reservoir 102 and a second chemistry reservoir 104, a bulk treating chemistry dispenser inlet 106, and a bulk treating chemistry dispenser outlet 108. The dispenser inlet 106 can be formed at an upper end of the bulk treating chemistry dispenser 100 and can be fluidly coupled to the water supply 40 by the dispensing nozzle 66 when the door assembly 24 is in the closed condition. The dispenser outlet 108 can be formed at a lower end of the bulk treating chemistry dispenser 100 and can be fluidly coupled to the treating chamber 18 when the door assembly 24 is in the closed condition. The dispenser outlet 108 can be provided as an opening in the bulk treating chemistry dispenser 100, and/or can include at least one spray nozzle.

The first and second reservoirs 102, 104 can be removably or detachably coupled to the bulk treating chemistry dispenser 100, the bulkhead 67, and/or the rear face 64. The first and second reservoirs 102, 104 can be positioned side-by-side within the bulk treating chemistry dispenser 100 and can be sized and shaped to extend along the vertical height of the access opening 63 such that the first and second reservoirs 102, 104 can protrude through and be received within the access opening 63 when the door assembly 24 is in the closed condition. In one example, when the reservoirs 102, 104 are positioned side-by-side, the dispenser inlet 106 and the dispenser outlet 108 can be located between the reservoirs 102, 104. By way of non-limiting example, each of the reservoirs 102, 104 can be sized to hold at least 1.1 liters of a treating chemistry.

Each of the first and second reservoirs 102, 104 can include a closure, illustrated herein as a lid 110. The lid 110 can be any suitable type of closure that is movable relative to the reservoirs 102, 104 to selectively allow a treating chemistry to be added to an interior of the reservoirs 102, 104, non-limiting example of which include snap-fit lids, screw-on lids, plug type closures, or rotatable or pivotable lids that can be hingedly coupled to the reservoirs 102, 104. The lids 110 are illustrated herein as pivotable or flip lids 110. A finger recess 112 can be provided adjacent at least one edge of the lid 110 to allow a user access to contact or grip the edge of the lid 110 in order to open the lid 110 to allow for cleaning or adding treating chemistry to the reservoirs 102, 104. Each lid 110 can also be provided with an indicia 114, which can be a symbol, image, or text to indicate, by way of non-limiting example, a type of chemistry to be contained within the reservoirs 102, 104. While such an indicia 114 is illustrated herein as being provided on the lid 110, it will be understood that the indicia 114 could alternatively be provided on the reservoirs 102, 104.

The reservoirs 102, 104 can further include or define a handle, illustrated herein as a grip recess 116 that can be configured, such as being shaped, sized, or contoured, to be grasped by a user to facilitate removal of the reservoirs 102, 104 from the bulk treating chemistry dispenser 100. The reservoirs 102, 104 can be retained within the bulk treating chemistry dispenser 100 by a snap fit or an interference fit such that a user is able to remove the reservoirs 102, 104 by gripping the grip recess 116 and pulling or lifting the reservoirs 102, 104. The reservoirs 102, 104 can further include a fill indicia 118 comprising a visual indicator of a current level of treating chemistry within the reservoirs 102, 104. The fill indicia 118 can include a viewing window 120, which can be provided as at least a portion of the reservoir 102, 104 that is transparent and provides a view of at least a portion of the interior of the reservoir 102, 104 so that a user can view a fill level of the treating chemistry within the reservoir 102, 104.

Figure 4:
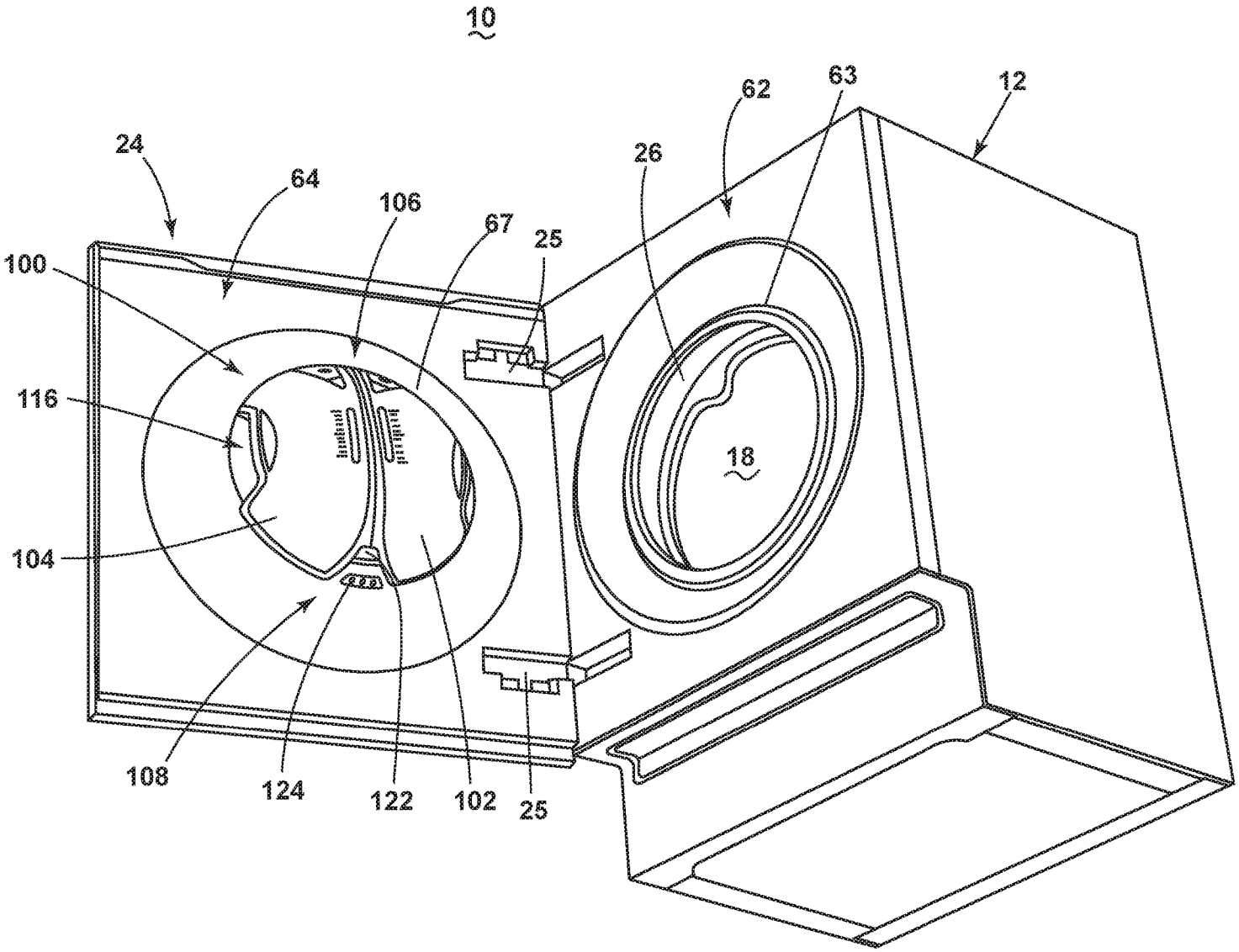
FIG. 4 is a bottom perspective view of the laundry treating appliance, the door assembly in the opened condition, and the bulk treating chemistry dispenser of FIG. 3.

Referring now to FIG. 4, the dispenser outlet 108 can comprise a mixing conduit outlet 122 and a cleaning outlet 124. The mixing conduit outlet 122 is fluidly coupled to the dispenser inlet 106 and can be provided at the lowermost point of abutment between the first and second reservoirs 102, 104. In one example, the reservoirs 102, 104 can at least partially define the mixing conduit outlet 122. The mixing conduit outlet 122 is configured to provide liquid that exits the mixing conduit outlet 122 to the treating chamber 18 and can be provided as an opening defined by the bulk treating chemistry dispenser 100 or as at least one spray nozzle that is positioned or oriented to spray toward the treating chamber 18.

Figure 7:
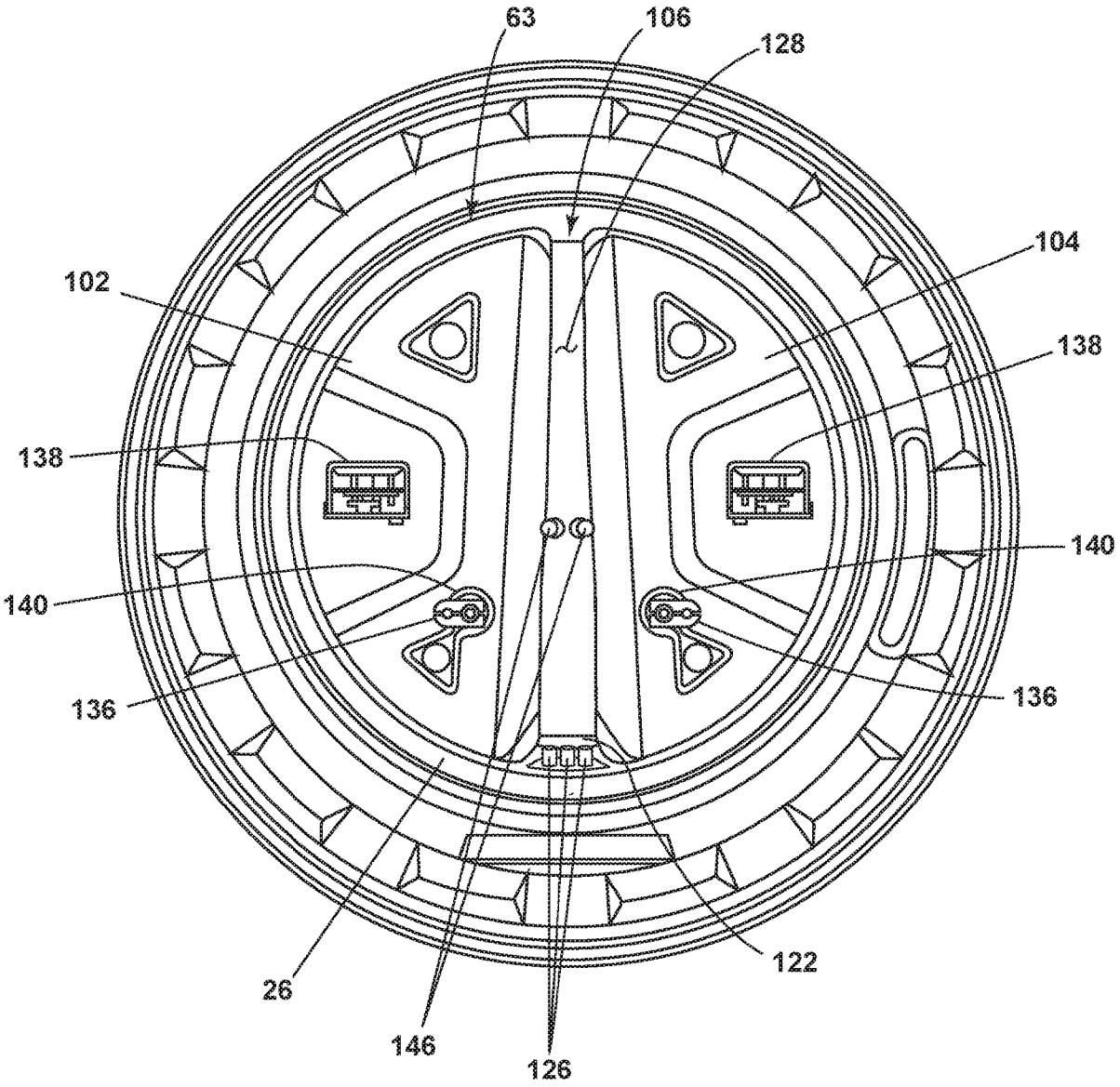
FIG. 7 is a cross-sectional view of the bulk treating chemistry dispenser of FIG. 5 taken from the rear face of the door assembly.

The cleaning outlet 124 is fluidly coupled to the dispenser inlet 106 and can be provided adjacent the mixing conduit outlet 122 at the lower end of the bulk treating chemistry dispenser 100. In one example, the cleaning outlet 124 can be located between the mixing conduit outlet 122 and the rear face 64 or the bulkhead 67. However, it will be understood that any suitable location for the cleaning outlet 124 on the bulk treating chemistry dispenser 100 can be used, such that the cleaning outlet 124 is positioned to be able to provide a spray of liquid onto at least a portion of the bellows 26. In one example, the cleaning outlet 124 can be positioned at the lower end of the bulk treating chemistry dispenser 100 such that the cleaning outlet 124 at least partially overlies the bellows 26 when the door assembly 24 is in the closed condition. The cleaning outlet 124 can include at least one cleaning spray nozzle 126 (FIG. 7). While the cleaning outlet 124 is illustrated herein as including a set of three cleaning spray nozzles 126, it will be understood that any suitable number of cleaning spray nozzles 126 can be used. The cleaning spray nozzles 126 can be positioned or oriented to deliver the spray of liquid toward the bellows 26 when the door assembly 24 is in the closed condition in order to perform cleaning of the bellows 26.

Figure 5:
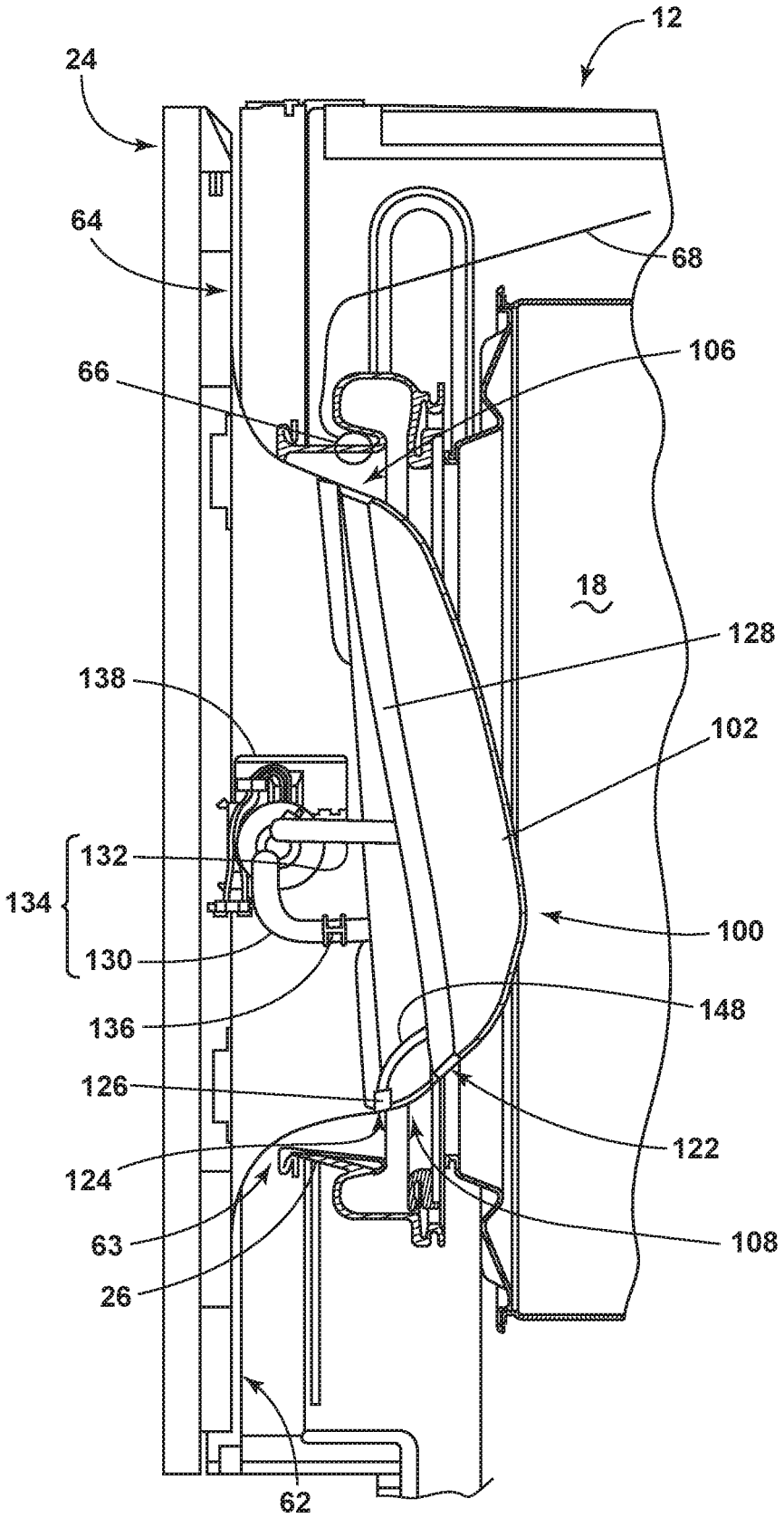
FIG. 5 is a cross-sectional view of the door assembly and the bulk treating chemistry dispenser of FIG. 3 with the door assembly in a closed condition.

Referring now to FIG. 5, when the door assembly 24 is in the closed condition, the bulk treating chemistry dispenser 100 protrudes through the access opening 63, and is additionally received within and abutting the bellows 26. The dispensing nozzle 66 can be provided on the bellows 26. In one aspect, the dispensing nozzle 66 can at least partially protrude through the bellows 26. When the door assembly 24 is in the closed condition, the dispensing nozzle 66 is positioned adjacent the dispenser inlet 106 such that water provided from the water supply 40 to the dispensing nozzle 66 can flow from the dispensing nozzle 66 and into the dispenser inlet 106. In one example, the dispensing nozzle 66 can be at least partially aligned with the dispenser inlet 106.

A mixing conduit 128 extends between and fluidly couples the dispenser inlet 106 with the dispenser outlet 108, and specifically the mixing conduit outlet 122. The mixing conduit 128 can be provided between the reservoirs 102, 104 and can extend along the vertical height of the reservoirs 102, 104, and thus the access opening 63. The mixing conduit 128 can be defined by a housing or a conduit provided within the bulk treating chemistry dispenser 100 regardless of whether or not the reservoirs 102, 104 are received in place within the bulk treating chemistry dispenser 100, or the first and second reservoirs 102, 104 can at least partially collectively form the mixing conduit 128.

A first conduit portion 130 and a second conduit portion 132 can be collectively thought of as forming a treating chemistry supply conduit 134 that fluidly couples the mixing conduit 128 with at least one of the reservoirs 102, 104. The treating chemistry supply conduit 134 can include and be fluidly coupled to a pump assembly 138, which can be a hydraulic pump assembly 138, that is configured to provide the treating chemistry from the reservoir 102, 104 into the mixing conduit 128. In one example, the first conduit portion 130 can extend between and fluidly couple the reservoir 102, 104 to the pump assembly 138, while the second conduit portion 132 can extend between and fluidly couple the pump assembly 138 to the mixing conduit 128. The treating chemistry supply conduit 134, and specifically the first conduit portion 130, can include a plunger 136 that can be configured to dock with the reservoir 102, 104 and can allow treating chemistry to flow from the reservoir 102, 104 to the first conduit portion 130 only when the pump assembly 138 is operated and to prevent treating chemistry from entering the first conduit portion 130 when the pump assembly 138 is not operated.

In one example, the pump assembly 138 can be positioned between the rear face 64 and the reservoirs 102, 104. The pump assembly 138 can be at least partially received within the bulkhead 67 portion of the door assembly 24. The bulk treating chemistry dispenser 100 of the present disclosure can be used with a variety of laundry treating appliances 10 having various configurations for the door assembly 24, including built-in and not built-in laundry treating appliances 10, and door assemblies 24 that can extend along and selectively cover either the entire front panel 62 or only a portion of the front panel 62, such as the access opening 63. For example, in the case that the laundry treating appliance 10 is a built-in laundry treating appliance 10, the door assembly 24 can extend along and selectively cover the entire front panel 62, while the bulkhead 67 portion of the door assembly 24 selectively covers the access opening 63 and serves to mount the bulk treating chemistry dispenser 100 that is selectively received within the access opening 63, such that the door assembly 24 provides for only a single door to be opened in order for a user to access the treating chamber 18. In one example, the front surface 58 of the door assembly 24 can be opaque, so as to prevent viewing of the bulk treating chemistry dispenser 100 and the pump assembly 138 from an exterior of the laundry treating appliance 10 when the door assembly 24 is in the closed condition.

A cleaning nozzle conduit 148 can be provided to fluidly couple the cleaning spray nozzles 126 with the mixing conduit 128. The cleaning nozzle conduit 148 can be configured to allow liquid to flow from the mixing conduit 128 to the cleaning spray nozzles 126 passively, such as by flow of gravity. Alternatively, the cleaning nozzle conduit 148 can have a pump (not shown), as in the arrangement of the treating chemistry supply conduit 134 and pump assembly 138. Such a pump can be configured to provide liquid, which can be only water or a mix of treating chemistry and water, from the mixing conduit 128 to the cleaning spray nozzles 126 and can be positioned between the rear face 64 and the reservoirs 102, 104.

Figure 6:
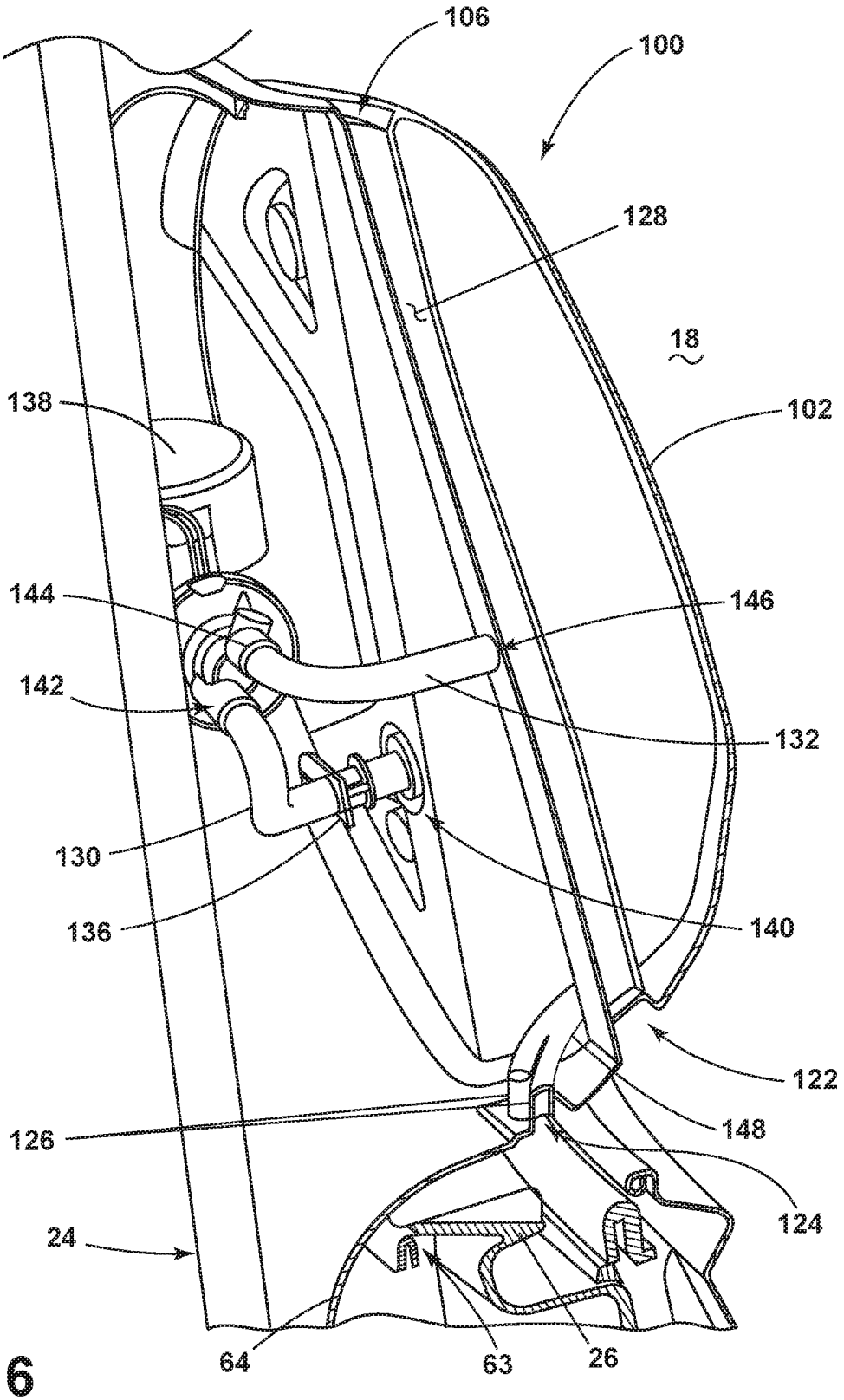
FIG. 6 is a perspective view of the cross-section of the bulk treating chemistry dispenser of FIG. 5.

Referring now to FIG. 6, the reservoirs 102, 104 can each define a dispensing opening 140 within which the plunger 136 can be received when the reservoirs 102, 104 are docked with the bulk treating chemistry dispenser 100 in order to fluidly couple the reservoirs 102, 104 with the first conduit portion 130. The pump assembly 138 comprises a pump inlet 142 and a pump outlet 144. The mixing conduit 128 can define at least one treating chemistry inlet 146. The first conduit portion 130 can fluidly couple the dispensing opening 140 with the pump inlet 142. The second conduit portion 132 can fluidly couple the pump outlet 144 with the treating chemistry inlet 146.

While the cleaning nozzle conduit 148 is illustrated herein as being a branched conduit that fluidly couples each of the cleaning spray nozzles 126 with the mixing conduit 128 via a single, common cleaning nozzle conduit 148, it will be understood that multiple cleaning nozzle conduits 148 can be included, such that each of the cleaning spray nozzles 126 is fluidly coupled to the mixing conduit 128 via a dedicated, non-branched cleaning nozzle conduit 148. In addition, while the cleaning nozzle conduit 148 is illustrated herein as being coupled to the mixing conduit 128 at a lower end of the bulk treating chemistry dispenser 100, it is contemplated that the cleaning nozzle conduit 148 can couple to the mixing conduit 128 at any suitable point along the mixing conduit 128, can couple directly to the dispenser inlet 106, or can be fluidly coupled with the dispensing nozzle 66 independently of the mixing conduit 128.

Referring now to FIG. 7, a front cross-sectional view of the laundry treating appliance 10 with the door assembly 24 in the closed condition shows a rear view of a portion of the bulk treating chemistry dispenser 100 where it can be more clearly seen that the reservoirs 102, 104 can at least partially define the mixing conduit 128, as well as the dispenser inlet 106 and the mixing conduit outlet 122. It can also be appreciated that each of the reservoirs 102, 104 is provided with a dedicated pump assembly 138, a plunger 136, a dispensing opening 140, and a treating chemistry inlet 146 to the mixing conduit 128.

Figure 8:
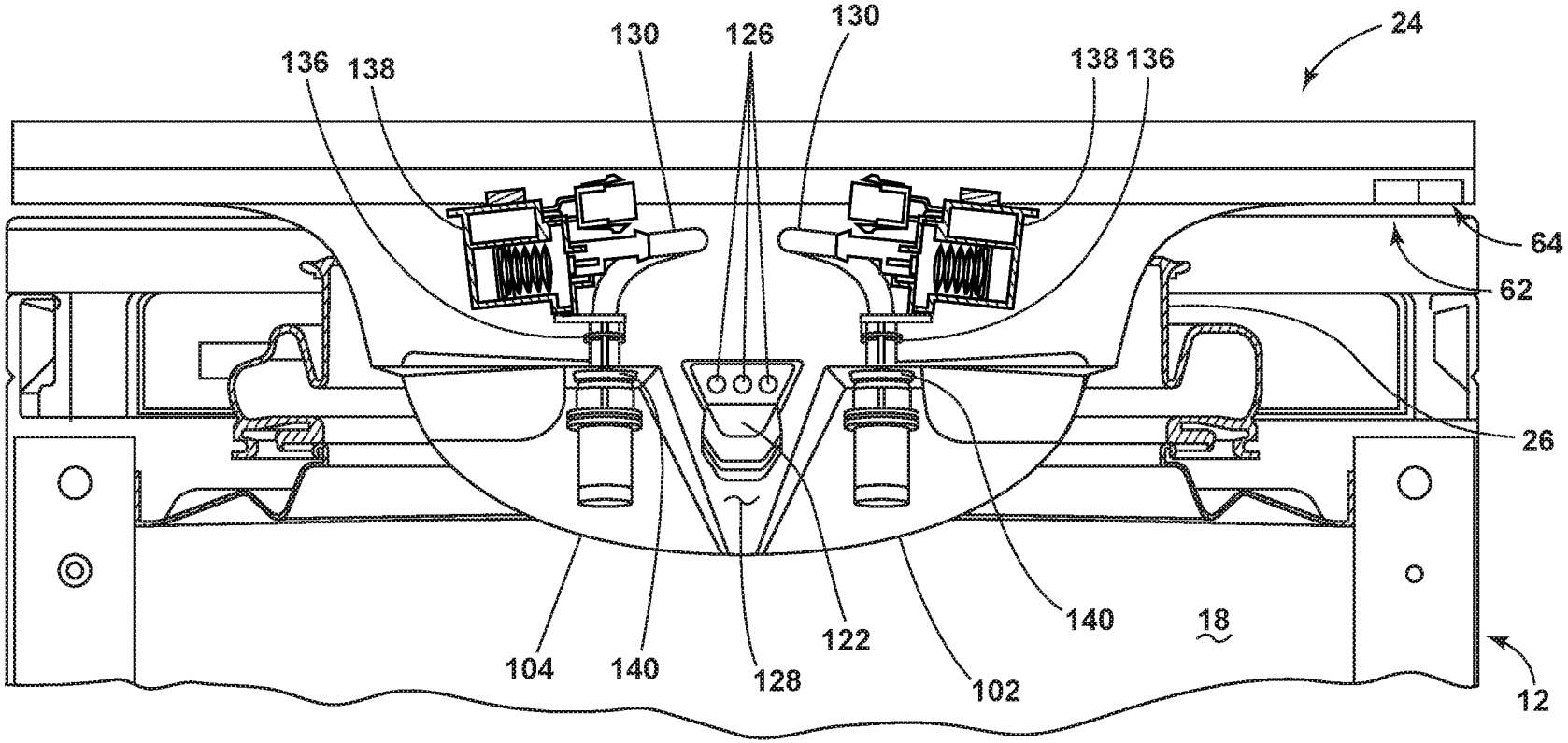
FIG. 8 is a cross-sectional view of the bulk treating chemistry dispenser of FIG. 5 taken from a top of the bulk treating chemistry dispenser.

Referring now to FIG. 8, a top cross-sectional view of the bulk treating chemistry dispenser 100 with the door assembly 24 in the closed condition relative to the cabinet 12 illustrates the coupling of the first reservoir 102 to the mixing conduit 128 by the first conduit portion 130 of the first supply conduit 134 via the first pump assembly 138, while the second reservoir 104 is coupled to the mixing conduit 128 by the second first conduit portion 130 of the second supply conduit 134 via the second pump assembly 138.

Turning now to the operation of the bulk treating chemistry dispenser 100, water can be supplied to the bulk treating chemistry dispenser 100 from the dispensing supply conduit 68 and the dispensing nozzle 66 when so directed by the controller 30 for a cycle of operation. Water dispensed from the dispensing nozzle 66 can enter the bulk treating chemistry dispenser 100 through the dispenser inlet 106 to flow into the mixing conduit 128. While water is supplied to the mixing conduit 128 of the bulk treating chemistry dispenser 100, at least one of the pump assemblies 138 can be operated to supply at least one treating chemistry from at least one of the reservoirs 102, 104 to the mixing conduit 128. While the operation of the bulk treating chemistry dispenser 100 is described herein as providing treating chemistry to the mixing conduit 128 concurrently with the supply of water to the mixing conduit 128, it will be understood that treating chemistry can also be supplied to the mixing conduit 128 independently of the supply of water to the mixing conduit 128.

The selection of the reservoir 102, 104 from which the treating chemistry is to be pumped can be determined by the cycle of operation. For example, during a pre-wash or a wash phase of the cycle of operation, a detergent can be supplied to the mixing conduit 128 from the first reservoir 102, while a fabric softener can be supplied to the mixing conduit 128 from the second reservoir 104 at a subsequent phase of the cycle of operation. Alternatively, treating chemistries from both the first and second reservoirs 102, 104 can be supplied to the mixing conduit 128 at the same time.

The contents or the type of treating chemistry stored within the treating chemistry reservoirs 102, 104 can be a parameter defined by the laundry treating appliance 10, or it can be a user-selectable variable. By way of non-limiting example, the laundry treating appliance 10 can be programmed via the controller 30 to recognize the first treating chemistry reservoir 102 as being designated for a detergent, while the second treating chemistry reservoir 104 can be designated for containing a fabric softener. Alternately, a user can instruct the controller 30 as to what is contained in the treating chemistry reservoirs 102, 104 by entering such information into the user interface 32. By way of non-limiting example, a user can input information to the user interface 32 indicating that the first treating chemistry reservoir 102 contains a detergent while the second treating chemistry reservoir 104 contains a fabric softener or a stain treating chemistry, or that both treating chemistry reservoirs 102, 104 contain a detergent, or any desired combination.

Based on information received by or programmed into the controller 30 as to the contents of the treating chemistry reservoirs 102, 104, the controller 30 can determine an appropriate amount of a treating chemistry from one or more of the treating chemistry reservoirs 102, 104 that should be taken from the bulk treating chemistry dispenser 100 at a predetermined appropriate point during the automatic cycle of operation, and the controller 30 can control the operation of at least one of the pump assemblies 138 accordingly to remove the appropriate amount of the treating chemistry from at least one of the treating chemistry reservoirs 102, 104 at the appropriate time.

When the controller 30 determines that treating chemistry should be supplied from at least one of the reservoirs 102, 104, the pump assembly 138 operates to draw treating chemistry from the at least one of the reservoirs 102, 104 through the dispensing opening 140 to the first conduit portion 130, into the pump inlet 142 to the pump outlet 144, through the second conduit portion 132, and into the mixing conduit 128 via the treating chemistry inlet 146. The treating chemistry pumped into the mixing conduit 128 by the pump assembly 138 mixes with the water that has entered the mixing conduit 128 through the dispenser inlet 106 in order to form a water-treating chemistry mixture within the mixing conduit 128. In one example, the water-treating chemistry mixture within the mixing conduit 128 can then be supplied to the mixing conduit outlet 122 by gravity flow or with the aid of a pump to enter the treating chamber 18.

In place of, or in addition to, the supplying of the water-treating chemistry mixture to the treating chamber 18 through the mixing conduit outlet 122, water-treating chemistry mixture can flow from the mixing conduit 128, through the cleaning nozzle conduit 148, and can then exit the bulk treating chemistry dispenser 100 through the cleaning spray nozzles 126 of the cleaning outlet 124 to additionally provide the function of cleaning of the bellows 26. The supply of the water-treating chemistry mixture from the mixing conduit 128 to the cleaning spray nozzles 126 can be driven by gravity flow, as well as under the operation of a valve or a pump. The water-treating chemistry mixture can be supplied from the cleaning spray nozzles 126 so as to be sprayed directly onto the bellows 26 to clean the bellows 26.

The operation of the bulk treating chemistry dispenser 100 to provide cleaning of the bellows 26 through the cleaning spray nozzles 126 can occur automatically as a part of certain cycles of operation, can be programmed to occur when a predetermined number of cycles of operation of the laundry treating appliance 10 have been completed or after a predetermined length of time, or can occur when directed to occur by a user by way of an input to the user interface 32, independently of the normal laundry treating cycle of operation. The user can also select, at the user interface 32, if the cleaning of the bellows 26 should be done with water only, or with the water-treating chemistry mixture.

The aspects of the present disclosure described herein set forth a bulk treating chemistry dispenser for a laundry treating appliance that allows for improved user experience and flexibility. The positioning of the bulk treating chemistry reservoirs on the rear face of the door can allow a user easy access to the treating chemistry reservoirs, which can either be filled in place within the bulk treating chemistry dispenser, or can be removed to be filled at a more convenient location for the user. This also allows for previously unused space within the door assembly and received within and abutting the bellows to be efficiently used as the location for the bulk treating chemistry dispenser to allow for the storage of large quantities of treating chemistries that can be dispensed on a load-by-load basis. In addition, the treating chemistry reservoirs include features that allow for easy insertion, easy removability, and easy alignment with the bulk treating chemistry dispenser, as well as easily allowing a user to check the fill level of the reservoirs without removing the reservoirs from the bulk treating chemistry dispenser. Methods are also provided for leveraging the location of the bulk treating chemistry dispenser in order to provide a cleaning function for the bellows, which can otherwise retain buildup of treating chemistries, bacteria, debris, and water, eventually resulting in unpleasant odors to a user.

Specifically in the context of a built-in laundry treating appliance, the aspects of the present disclosure set forth a laundry treating appliance wherein a user need only open a single door in order to gain access to the drum and to the treating chamber. In the case of traditional built-in appliances, two doors are typically provided. A first, inner door is typically provided to selectively cover the access opening, often similar to doors found on traditional non-built-in laundry treating appliances. A built-in laundry treating appliance, however, will also include a second, outer door that extends along and selectively covers the entire height and width of the laundry treating appliance, and can have an appearance to match the outer cabinetry of, for example, a kitchen or bathroom of the user. Thus, the user must open both doors in order to gain access to the treating chamber for loading laundry items, which can be bothersome. The laundry treating appliance disclosed herein would allow for a built-in laundry treating appliance which can still have an outer appearance to match surrounding cabinetry, and further wherein a user need only open a single door to gain access to the treating chamber, resulting in an improved user experience and improved convenience.

To the extent not already described, the different features and structures of the various aspects can be used in combination with each other as desired. That one feature is not illustrated in all of the aspects is not meant to be construed that it cannot be, but is done for brevity of description. Thus, the various features of the different aspects can be mixed and matched as desired to form new aspects, whether or not the new aspects are expressly described.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A laundry treating appliance for treating laundry items according to an automatic cycle of operation, the laundry treating appliance comprising:

a cabinet defining an interior and having a front panel that at least partially defines an access opening to the interior;

a treating chamber located within the cabinet and accessible by the access opening;

a bellows extending between the treating chamber and the access opening;

a closure movably mounted to the cabinet to selectively open and close the access opening and having a rear face confronting the treating chamber when the closure closes the access opening; and a bulk treating chemistry dispenser mounted to the rear face and protruding through the access opening and abutting the bellows when the closure closes the access opening, the bulk treating chemistry dispenser comprising:

at least one bulk treating chemistry reservoir extending along a vertical height of the access opening;

a dispenser inlet formed at an upper end of the bulk treating chemistry dispenser and fluidly coupled to a water supply;

a dispenser outlet formed at a lower end of the bulk treating chemistry dispenser and fluidly coupled to the treating chamber, the dispenser outlet comprising at least two spray nozzles with a first spray nozzle configured to provide a spray toward the treating chamber and a second spray nozzle configured to provide a spray toward the bellows; and a mixing conduit extending between the dispenser inlet and the dispenser outlet and fluidly coupled to the at least one bulk treating chemistry reservoir.

2. The laundry treating appliance of claim 1 wherein the laundry treating appliance is a built-in laundry treating appliance and the closure comprises an opaque front surface that prevents viewing of the bulk treating chemistry dispenser from an exterior of the laundry treating appliance when the closure closes the opening.

3. The laundry treating appliance of claim 1 wherein the at least one bulk treating chemistry reservoir is removable from the bulk treating chemistry dispenser.

4. The laundry treating appliance of claim 1 wherein the bulk treating chemistry dispenser further comprises at least one supply conduit fluidly coupling the at least one bulk treating chemistry reservoir to the mixing conduit.

5. The laundry treating appliance of claim 4 wherein the at least one supply conduit includes at least one pump configured to provide a treating chemistry from the at least one bulk treating chemistry reservoir into the mixing conduit.

6. The laundry treating appliance of claim 5 wherein the at least one pump is positioned between the rear face and the at least one bulk treating chemistry reservoir.

7. The laundry treating appliance of claim 5 wherein the treating chemistry pumped into the mixing conduit mixes with water entering the mixing conduit from the dispenser inlet to form a water-treating chemistry mixture within the mixing conduit.

8. The laundry treating appliance of claim 1 wherein the at least one bulk treating chemistry reservoir comprises first and second bulk treating chemistry reservoirs positioned side-by-side within the bulk treating chemistry dispenser and each extending along the vertical height of the access opening.

9. The laundry treating appliance of claim 8 wherein the mixing conduit is positioned between the first and second bulk treating chemistry reservoirs.

10. The laundry treating appliance of claim 9 wherein the first and second bulk treating chemistry reservoirs collectively form the mixing conduit.

11. The laundry treating appliance of claim 8 wherein a first supply conduit fluidly couples the first bulk treating chemistry reservoir to the mixing conduit and a second supply conduit fluidly couples the second bulk treating chemistry reservoir to the mixing conduit.

12. The laundry treating appliance of claim 11 wherein the first and second supply conduits each include a pump positioned between the rear face and the first and second bulk treating chemistry reservoirs and configured to provide treating chemistries from the first and second bulk treating chemistry reservoirs into the mixing conduit.

13. The laundry treating appliance of claim 1 wherein the bulk treating chemistry dispenser further comprises a visual indicator of a current level of treating chemistry within the at least one bulk treating chemistry reservoir.

14. The laundry treating appliance of claim 13 wherein the visual indicator comprises a window located on the bulk treating chemistry dispenser providing a view of at least a portion of the at least one bulk treating chemistry reservoir.

15. The laundry treating appliance of claim 1 wherein a nozzle is provided on the bellows, the nozzle fluidly coupled to the water supply and positioned adjacent the dispenser inlet to provide water from the water supply to the dispenser inlet.

16. The laundry treating appliance of claim 1 wherein the second spray nozzle can be configured to provide the spray to the bellows for cleaning of the bellows independently of a laundry treating cycle of operation that provides the spray toward the treating chamber through the first spray nozzle.

17. A laundry treating appliance for treating laundry items according to an automatic cycle of operation, the laundry treating appliance comprising:

a cabinet defining an interior and having a front panel that at least partially defines an access opening to the interior;

a treating chamber located within the cabinet and accessible by the access opening;

a closure movably mounted to the cabinet to selectively open and close the access opening and having a rear face confronting the treating chamber when the closure closes the access opening; and a bulk treating chemistry dispenser mounted to the rear face and protruding through the access opening when the closure closes the access opening, the bulk treating chemistry dispenser comprising:

at least one bulk treating chemistry reservoir extending along a vertical height of the access opening;

a dispenser inlet formed at an upper end of the bulk treating chemistry dispenser and fluidly coupled to a water supply;

a dispenser outlet formed at a lower end of the bulk treating chemistry dispenser and fluidly coupled to the treating chamber, the dispenser outlet comprising at least two spray nozzles with a first spray nozzle configured to provide a spray toward the treating chamber and a second spray nozzle configured to provide a spray toward a bellows extending between the treating chamber and the access opening; and a mixing conduit extending between the dispenser inlet and the dispenser outlet and fluidly coupled to the at least one bulk treating chemistry reservoir.

18. The laundry treating appliance of claim 17 wherein the bulk treating chemistry dispenser is received within and abuts the bellows when the closure closes the opening.

19. A laundry treating appliance for treating laundry items according to an automatic cycle of operation, the laundry treating appliance comprising:

a cabinet defining an interior and having a front panel that at least partially defines an access opening to the interior;

a treating chamber located within the cabinet and accessible by the access opening;

a closure movably mounted to the cabinet to selectively open and close the access opening and having a rear face confronting the treating chamber when the closure closes the access opening; and a bulk treating chemistry dispenser mounted to the rear face and protruding through the access opening when the closure closes the access opening, the bulk treating chemistry dispenser comprising:

at least one bulk treating chemistry reservoir extending along a vertical height of the access opening;

a dispenser inlet formed at an upper end of the bulk treating chemistry dispenser and fluidly coupled to a water supply;

a dispenser outlet formed at a lower end of the bulk treating chemistry dispenser and fluidly coupled to the treating chamber, the dispenser outlet comprising at least one spray nozzle with the at least one spray nozzle configured to provide a spray toward a bellows; and a mixing conduit extending between the dispenser inlet and the dispenser outlet and fluidly coupled to the at least one bulk treating chemistry reservoir.

20. The laundry treating appliance of claim 19 wherein the at least one spray nozzle comprises two spray nozzles with a first spray nozzle configured to provide a spray toward the treating chamber and a second spray nozzle configured to provide a spray toward the bellows extending between the treating chamber and the access opening.

* * * * *